US007299606B2

(12) United States Patent
Bonatti et al.

(10) Patent No.: US 7,299,606 B2
(45) Date of Patent: Nov. 27, 2007

(54) METHOD FOR DISPENSING FLUID SUBSTANCES INTO CONTAINERS

(75) Inventors: Davide Bonatti, Mantova (IT); Enrico Galimberti, Porto Mantovano (IT); Stefano Cavallari, Bologna (IT)

(73) Assignee: Azionaria Costruzioni Macchine Automatiche A.C.M.A. S.p.A., Bologna (IT)

( * ) Notice: Subject to any disclaimer, the term of this patent is extended or adjusted under 35 U.S.C. 154(b) by 68 days.

(21) Appl. No.: 10/530,441

(22) PCT Filed: Oct. 6, 2003

(86) PCT No.: PCT/IB03/04397

§ 371 (c)(1),
(2), (4) Date: Apr. 7, 2005

(87) PCT Pub. No.: WO2004/033300

PCT Pub. Date: Apr. 22, 2004

(65) Prior Publication Data

US 2006/0011261 A1 Jan. 19, 2006

(30) Foreign Application Priority Data

Oct. 8, 2003 (IT) ..... BO02A0633

(51) Int. Cl.
*B65B 3/04* (2006.01)
*B65B 65/00* (2006.01)

(52) U.S. Cl. ..... 53/473; 53/167; 141/91

(58) Field of Classification Search ..... 53/471
See application file for complete search history.

(56) References Cited

U.S. PATENT DOCUMENTS

| | | | | |
|---|---|---|---|---|
| 2,638,259 | A | | 5/1953 | Garrett |
| 4,964,444 | A | * | 10/1990 | Hanerus et al. ..... 141/90 |
| 5,326,422 | A | * | 7/1994 | Kronseder ..... 156/566 |
| 5,340,949 | A | * | 8/1994 | Fujimura et al. ..... 177/25.18 |
| 5,713,403 | A | | 2/1998 | Cluesserath et al. |
| 6,014,994 | A | * | 1/2000 | Schmidt ..... 141/89 |
| 6,334,473 | B1 | | 1/2002 | Dumargue |

FOREIGN PATENT DOCUMENTS

| | | |
|---|---|---|
| EP | 1243546 | 9/2002 |
| GB | 2035973 | 6/1980 |

OTHER PUBLICATIONS

International Search Report dated Jan. 12, 2004.

* cited by examiner

*Primary Examiner*—John Sipos
(74) *Attorney, Agent, or Firm*—Timothy J. Klima

(57) ABSTRACT

In a machine (1) for filling containers with fluid products, different fluid substances are directed by means of a rotary valve assembly (19) into a tank (7) furnished with separate compartments (12, 13, 14, 15), isolated one from another and equipped each with at least one filler valve (8) by which a given quantity of one of the fluid substances is dispensed from the tank (7) into each container.

3 Claims, 5 Drawing Sheets

METHOD FOR DISPENSING FLUID SUBSTANCES INTO CONTAINERS

This application is the national phase of international application PCT/IB03/04397 filed Oct. 6, 2003 which designated the U.S. and that international application was published under PCT Article 21(2) in English. This application claims priority to Italian Patent application number BO 2002A 000633, filed Oct. 8, 2002, which is incorporated by reference herein.

TECHNICAL FIELD

The present invention relates to a method of dispensing fluid substances into containers.

The invention finds application to advantage in the art field of machines for filling containers both with liquid substances and with viscous substances.

BACKGROUND ART

Filling machines of the type referred to above appear substantially as a tank supported by a main carousel and holding a supply of the fluid substance; the carousel is rotatable about a vertical axis tangentially to a first transfer station by way of which it receives a succession of containers each affording a filler mouth.

The tank is rigidly associated with the carousel and affords a plurality of filler valves at the bottom, each of which can be associated with the mouth of a respective container in such a way that when the carousel is set in motion, the tank rotates about the vertical axis and its contents are dispensed by way of the filler valves into the containers, whereupon the filled containers are directed by way of a second transfer station onto an outfeed conveyor and thence to a further unit used in the manufacturing cycle, for example a capper or a labeller.

The solution of mounting the tank on top of the carousel as outlined above is advantageous in that it gives the equipment a compact geometry and manageable dimensions, but presents certain drawbacks strongly limiting versatility of use.

A first drawback consists in the fact that only one type of material can be dispensed into the containers, which excludes the possibility of using a single carousel to fill different containers with different substances in a single production run.

A further drawback derives from the difficulty encountered in cleaning the filler valves, which is a particularly important operation in the case of perishable materials such as foodstuffs. In effect, the valves and their delivery systems can be flushed clean only after the tank has been emptied completely and the production cycle terminated.

The object of the present invention is to provide a method of dispensing fluid substances into containers that will be unaffected by the drawbacks mentioned above in referring to the prior art.

DISCLOSURE OF THE INVENTION

The stated object is realized a method as recited and characterized in claim 1 appended.

The present invention relates also to a machine for dispensing fluid substances into containers.

The stated object is realized likewise in a machine as recited and characterized in claim 4 appended.

The invention will now be described in detail, by way of example, with the aid of the accompanying drawings, in which.

Figure 1:
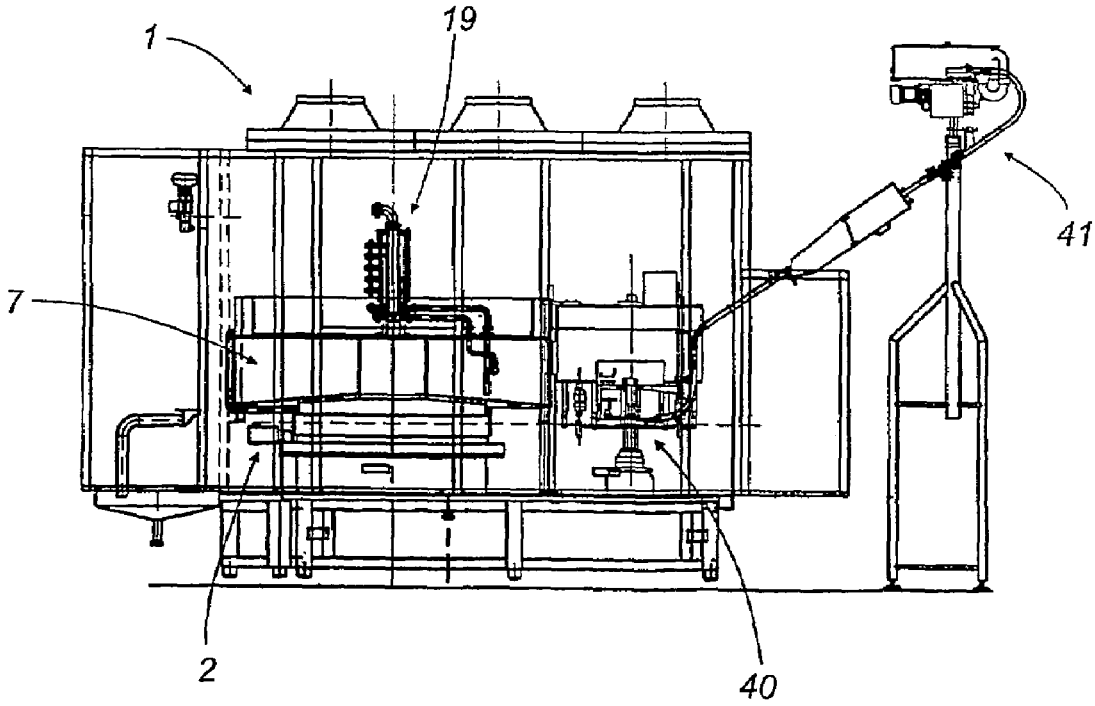
FIG. 1 illustrates a preferred embodiment of a filling machine equipped with a tank according to the present invention for dispensing fluid substances into containers, viewed schematically in elevation.

Referring to FIG. 1 of the drawings, 1 denotes a portion, in its entirety, of a filling machine by which fluid substances 2 are dispensed into containers (not illustrated).

Figure 2:
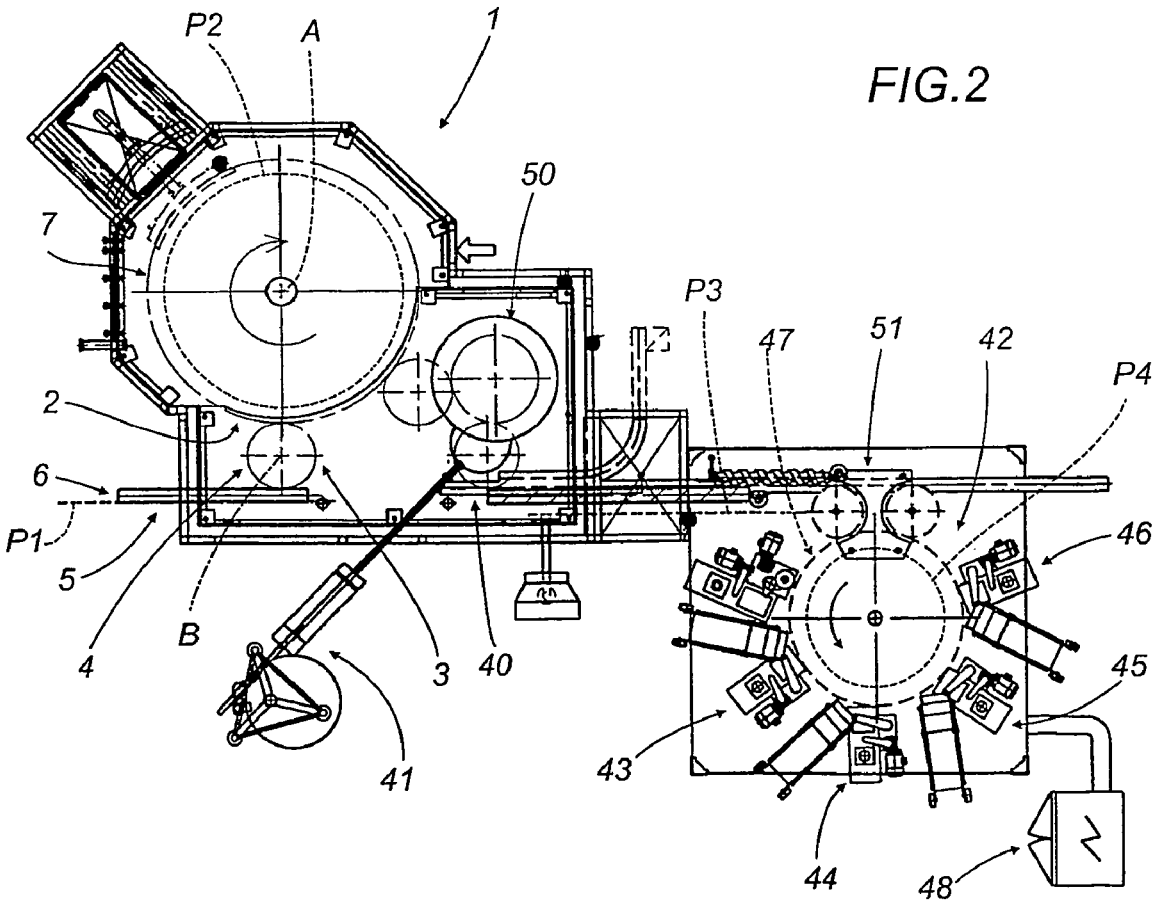
FIG. 2 shows the filling machine of FIG. 1, viewed schematically in plan from above.

As illustrated in FIGS. 1 and 2, the machine 1 comprises a main carousel 2 rotatable about a vertical axis A, turning clockwise as seen in FIG. 2 tangentially to a first transfer station 3 through which containers are supplied to the carousel singly and in succession by a rotary infeed conveyor 4. The infeed conveyor 4 rotates anticlockwise as seen in FIG. 2 about a vertical axis B parallel to the axis A first mentioned, turning tangentially to a first infeed station 5 at which it receives a succession of containers proceeding along a first predetermined path P1 afforded by a horizontal infeed channel 6.

The carousel 2 is disposed and embodied in such a way as to support the containers (not illustrated) and serves also to carry a tank 7, rigidly associated with the carousel 2 as it rotates about the axis A.

Figure 3:
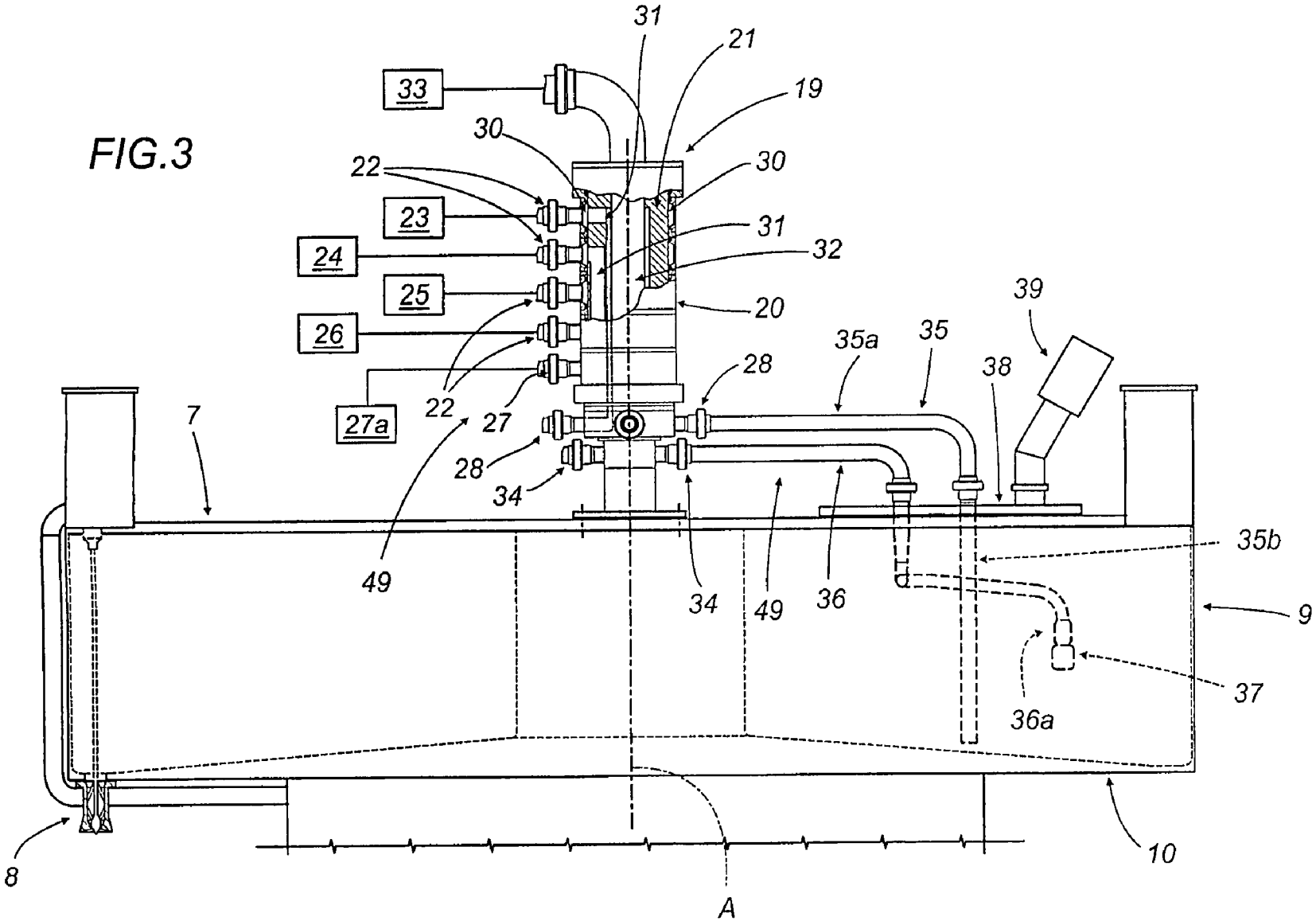
FIG. 3 is a detail of the machine illustrated in FIGS. 1 and 2, viewed in elevation.

Referring to FIG. 3, the tank 7 is furnished with a plurality of filler valves 8 spaced apart uniformly around the vertical axis A of rotation, of which one only is illustrated. The valves 8 are conventional in embodiment, and therefore not described further in the present specification either in respect of their structure or in respect of their operation.

Figure 4:
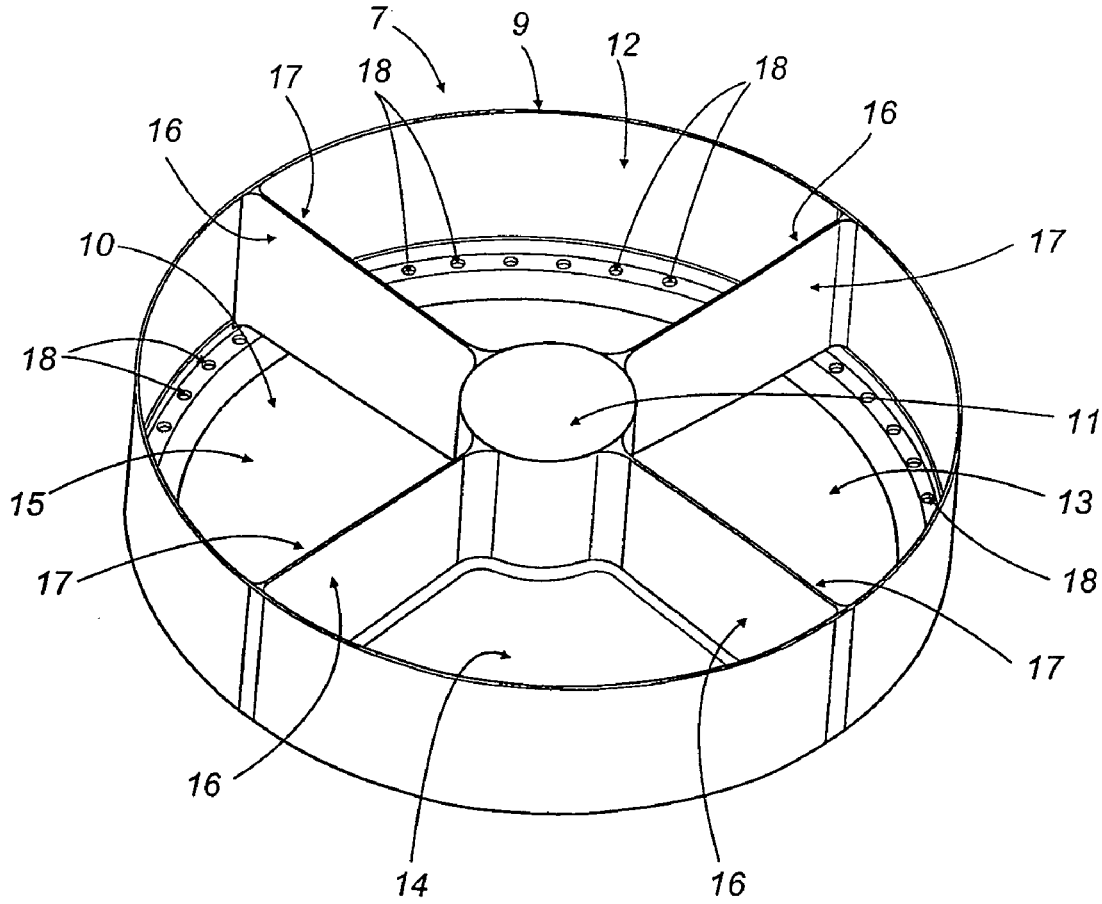
FIG. 4 is a detail of the machine illustrated in FIG. 1, viewed in perspective from above.

As discernible in FIG. 4, the tank 7 presents a substantially circular appearance, with a cylindrical side wall 9, a bottom 10 and a central opening 11, and comprises four compartments denoted 12, 13, 14 and 15, respectively, separated by four radial baffles 16 serving to establish four respective fluid tight partitions 17 between the four compartments 12, 13, 14 and 15.

Also illustrated in FIG. 4 is a plurality of holes 18 arranged around the periphery of the tank 7 and serving to connect the supply of fluid in the compartments 12, 13, 14 and 15 with four respective sets of filler valves 8 not indicated in the drawing.

FIG. 3 illustrates a rotary valve assembly 19, mounted above the tank 7, in alignment with the central opening 11, by which different fluid substances are supplied selectively to the different compartments 12, 13, 14 and 15.

The rotary valve assembly 19 comprises an external portion 20 that remains fixed relative to the angular movement of the tank about the vertical axis A, and an internal portion 21 that rotates as one with the carousel 2 and the tank 7 about the selfsame axis.

The fixed portion 20 presents a plurality of inlet ports 22 admitting the aforementioned different fluid substances from respective separate sources indicated schematically in the drawings by four respective blocks denoted 23, 24, 25 and 26, and a further inlet port 27 admitting pressurized air from a respective source indicated schematically by a further relative block denoted 27*a*. The four fluid inlet ports 22 and the air inlet port 27 are positioned on the fixed portion 20 at respective different heights relative to the vertical axis A of rotation.

Figure 5:
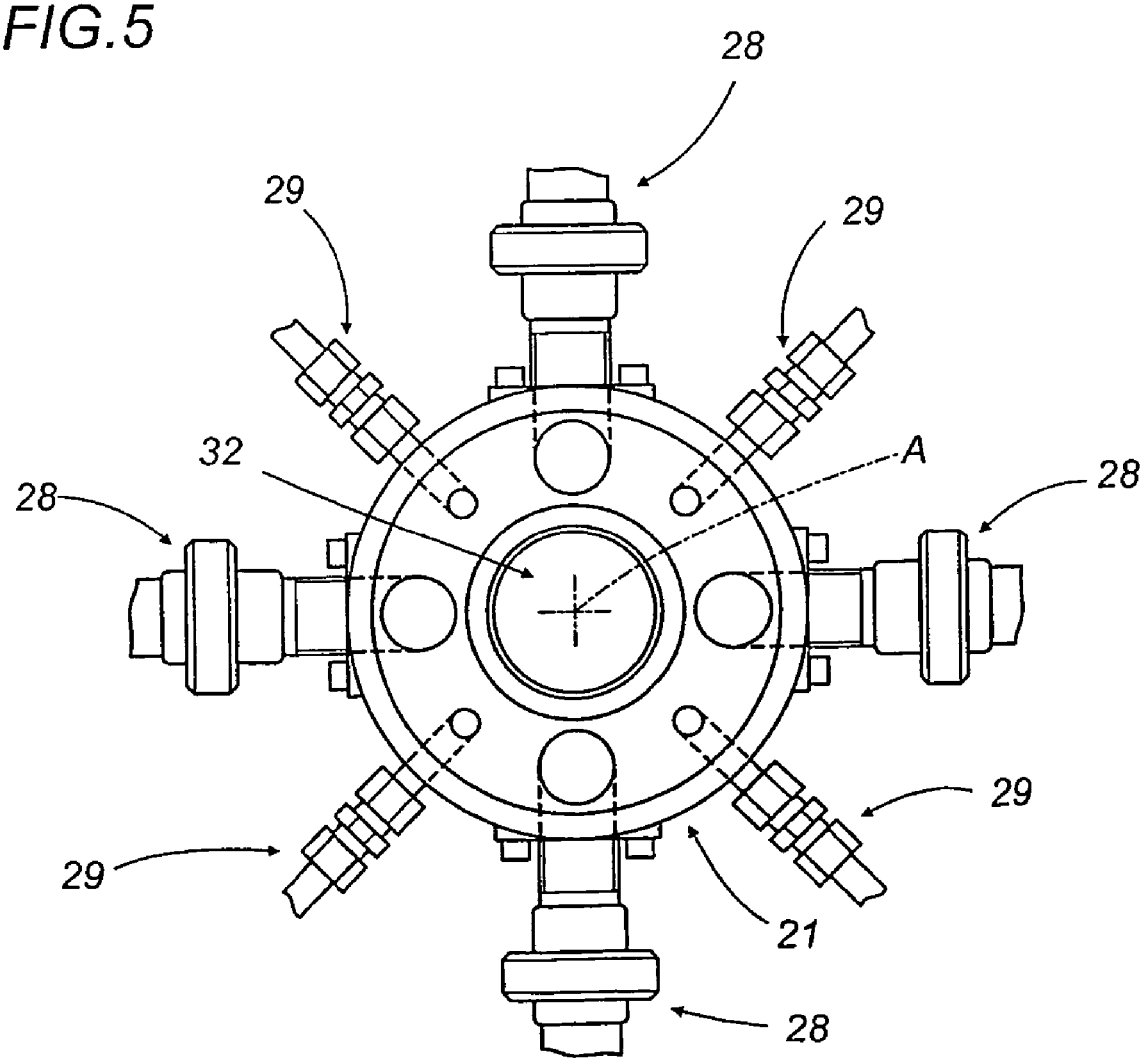
FIG. 5 is a detail of FIG. 3, viewed from above.

As discernible similarly in FIG. 5, the rotating internal portion 21 of the valve assembly 19 affords four fluid outlet ports 28 equispaced angularly about the axis A of rotation, and four valve elements 29 delivering the pressurized air admitted through the inlet port 27, equispaced angularly likewise about the axis A of rotation and offset from the fluid outlet ports 28.

Still referring to FIG. 3, the fixed external portion 20 of the valve assembly presents a plurality of annular channels 30 coinciding and communicating respectively with the fluid inlet ports 22, whilst the rotating internal portion 21 presents a set of vertical channels 31 extending substantially parallel to the axis A of rotation and coinciding respectively with the fluid outlet ports 28.

Each annular channel 30 is in fluid communication with a respective vertical channel 31, in such a way that each fluid inlet port 22 can be connected with a respective fluid outlet port 28, both during the rotation of the tank 7 about the axis A and whenever the tank 7 is stationary.

The rotary valve assembly 19 also comprises a central duct 32 through which to direct a flushing liquid into the tank 7.

The central duct 32 is in receipt of liquid from a source indicated schematically by a block denoted 33. From the bottom end of the duct 32, the liquid flows to four discharge outlets 34 associated rigidly with the rotating internal portion 21 and equispaced angularly about the axis A of rotation, substantially in alignment with and below the aforementioned fluid outlet ports 28.

Connected to each of the fluid outlets 28 is a respective pipeline 35 serving to replenish a relative compartment 12, 13, 14 and 15 of the tank 7. In the interests of simplicity, just one of the four pipelines 35 is shown in FIG. 3. The replenishing pipeline 35 presents a first horizontal portion 35*a* projecting substantially in a radial direction from the axis A, and a second vertical portion 35*b* that terminates in close proximity to the bottom 10 of the tank 7.

Similarly, connected to each liquid outlet 34 is a respective pipeline 36 serving to flush a relative compartment 12, 13, 14 and 15 of the tank 7. In the interests of simplicity, just one of the four pipelines 36 is shown in FIG. 3. The flushing pipeline 36 presents one end 36*a* located internally of the respective compartment 12, 13, 14 and 15 and carrying a nozzle 37 from which the flushing liquid is directed into the tank 7.

Both the replenishing pipelines 35 and the flushing pipelines 36 are supported by respective mounting elements 38.

The mounting elements 38 associated with the four compartments 12, 13, 14 and 15 carry respective sensors 39 of conventional type serving to monitor the quantity and the chemical and physical properties of the fluid substances contained in the selfsame compartments 12, 13, 14 and 15.

The bottom 10 of the tank 7 affords a plurality of openings not shown in the drawings, associated with each of the compartments 12, 13, 14 and 15, by way of which the fluid substances and the flushing liquids can be drained from the selfsame compartments 12, 13, 14 and 15.

As illustrated in FIGS. 1 and 2, the machine 1 comprises a station 40 at which containers filled with the fluid substances are capped. The capping station 40, being conventional in embodiment, is neither illustrated nor described further in the present specification. The caps, not illustrated, are supplied to the station 40 by a feed unit 41 also of conventional type.

The machine 1 is also equipped with a station 42 at which the filled and capped containers are labelled, comprising four labelling units 43, 44, 45 and 46 of conventional type, neither illustrated in detail nor described further. The four units 43, 44, 45 and 46 are positioned facing the periphery of a transfer carousel 47, likewise of conventional type and indicated schematically in FIG. 2 by a circular phantom line, on which the containers are advanced during the labelling operation.

Still in FIG. 2, the machine 1 comprises a master controller 48 by which the various filling, capping and labelling operations are supervised.

The sources 23, 24, 25 and 26 of fluid, the rotary valve assembly 19 and the replenishing pipelines 35 together constitute feed means 49 by which the fluid substances are supplied to the tank 7.

In operation, according to prior art practice and as illustrated in FIG. 2, containers (not shown) conveyed by way of the infeed channel 6 along the first path P1 and into the first transfer station 3 are taken up by the rotary infeed conveyor 4 and directed onto the main carousel 2.

The containers are held in position on the main carousel 2 by means of respective gripper elements not illustrated in the drawings, and carried thus along a predetermined circular conveying and filling path P2 extending around the axis A of rotation.

As the tank 7 rotates about the axis A, each filler valve 8 will draw into alignment with the mouth of a relative container carried by the carousel 2 and dispense a given quantity of the fluid substance from the tank 7 into the container.

With the carousel 2 and tank 7 rotating together as one, each container in turn is filled with the fluid substance from the tank 7 in conventional manner.

As illustrated in FIG. 4, the tank 7 is divided into four compartments 12, 13, 14 and 15, each one of which containing a different fluid substance.

Referring to FIG. 3, four different fluid substances flow from the respective sources 23, 24, 26 and 26 to the inlet ports 22 on the fixed external portion 20 of the valve assembly 19. The fluid substance entering through each port 22 occupies the corresponding annular channel 30, from where it can pass into a respective vertical channel 31 of the rotating internal portion 21 even when this component is set in rotation as a result of the tank 7, with which the internal portion 21 is rigidly associated, being caused to rotate about the vertical axis A.

The fluid substance passes down the vertical channel 31 to the relative outlet port 28, thence along the replenishing pipeline 35 and into the designated compartment 12, 13, 14 and 15.

In other words, as the tank 7 rotates, each of the compartments 12, 13, 14 and 15 into which it is divided can be supplied with a corresponding selected fluid substance.

The containers, directed singly and in succession onto the carousel 2, will be ordered in rows of predetermined number corresponding to the number of filler valves 8 serving each compartment 12, 13, 14 and 15, and aligned with the valves accordingly.

Thus, in the course of each complete revolution made by the tank 7 about the axis A, four groups of containers will be filled with fluid substances of different kinds, or rather, each group is filled with the fluid substance contained in the compartment 12, 13, 14 or 15 beneath which the containers of this same group are positioned.

After the filling step, the filled containers are released by the respective gripper elements of the carousel 2 and advanced by way of a second transfer station 50 to the capping station 40. Once capped, by methods of conventional type not described further, the containers will be directed along a rectilinear path P3 toward a third transfer station 51 serving the labelling station 42.

To reiterate, the labelling station 42 comprises a carousel 47 onto which the containers are directed from the transfer station 51 by conventional methods not described in the present specification.

The filled and capped containers are advanced by the carousel 47 around a circular path P4 along which the aforementioned labelling units 43, 44, 45 and 46 are stationed.

The master controller 48 pilots the operation of the carousel 42 and the labelling units 43, 44, 45 and 46 in such a way that these will apply different labels selectively to the containers advancing along the circular path P4, according to the type of fluid substance dispensed into each one.

In other words, containers of a given group that have all been filled with the same fluid substance from one of the compartments 12, 13, 14 or 15 will advance on the carousel 42 until in alignment with the particular unit 43, 44, 45 or 46 programmed to apply labels corresponding to and/or identifying the fluid substance effectively batched into the single containers of the group in question.

To advantage, the units 43, 44, 45 and 46 are arranged along the path P4 with the different labels ordered in the same sequence as the corresponding fluid products in the compartments 12, 13, 14 and 15 of the tank 7.

Employing the method disclosed, accordingly, it becomes possible to fill containers with different substances substantially at once, during the same production run of the filling machine, and therefore without having to suspend operations or carry out time-consuming and laborious cleaning procedures.

Likewise advantageously, a machine embodied in accordance with the present invention will allow one or more compartments to be flushed clean without interrupting the operation of filling containers from the remaining compartments, so that the production run can continue just the same, albeit with reduced output.

In an alternative embodiment of the invention not illustrated in the drawings, the filling machine 1 could comprise a capping or sealing station equipped with four different units by which containers filled with different fluid substances are fitted with different types of closures, according to the particular substance dispensed from the tank into the individual container.

In another alternative embodiment of the invention likewise not illustrated in the drawings, different containers are directed onto the carousel and beneath the tank 7, each furnished with elements identifying one of the different fluid substances with which it must be filled. The controller will be programmed to ensure that each container is positioned correctly under a given filler valve, so that it can be filled with the particular fluid substance designated by the identifying elements.

The invention claimed is:

1. A method of dispensing fluid substances into containers, comprising:

directing a plurality of different fluid substances into respective compartments of a tank, each compartment isolated one from another and including at least one filler valve;

replenishing each compartment of the tank at least in part;

dispensing a quantity of the fluid substance from a selected compartment of the tank into selected containers by way of the at least one filler valve;

draining off the respective fluid substance form one of the compartments of the tank;

cleaning the drained compartment with at least one flushing liquid;

discharging the flushing liquid from the cleaned compartment;

wherein the steps of draining off, cleaning, and discharging from the one compartment of the tank are done simultaneously with continuing the step of dispensing the respective fluid substance from any other compartment of the tank into the respective selected containers.

2. A method as in claim 1, and further comprising:

directing containers filled with the fluid substances to a station at which the respective containers are labeled, and applying different labels to the containers according to the particular fluid substance dispensed into each one.

3. A method as in claim 1, and further comprising:

directing containers filled with the fluid substances to a station at which the respective containers are closed, and applying different closures to the containers according to the particular fluid substance dispensed into each one.

* * * * *